US005628192A

United States Patent [19]

Hayes-Bradley et al.

[11] Patent Number: 5,628,192

[45] Date of Patent: May 13, 1997

[54] GAS TURBINE ENGINE COMBUSTION CHAMBER

[75] Inventors: Samantha Hayes-Bradley, Buckinghamshire; Ian J. Toon, Leicestershire; Jeffrey D. Willis, Coventry, all of England

[73] Assignee: Rolls-Royce, plc, London, England

[21] Appl. No.: 352,847

[22] Filed: Dec. 2, 1994

[30] Foreign Application Priority Data

Dec. 16, 1993 [GB] United Kingdom ..... 9325707

[51] Int. Cl.[6] ..... F23R 3/14; F23R 3/34

[52] U.S. Cl. ..... 60/733; 60/737; 60/746; 60/747; 60/748

[58] Field of Search ..... 60/733, 737, 742, 60/746, 747, 748

[56] References Cited

U.S. PATENT DOCUMENTS

| | | | |
|---|---|---|---|
| 2,704,435 | 3/1955 | Allen | 60/746 |
| 3,912,164 | 10/1975 | Lefebvre et al. | 60/748 |
| 5,319,935 | 6/1994 | Toon et al. | 60/748 |
| 5,408,825 | 4/1995 | Foss et al. | 60/742 |
| 5,475,979 | 12/1995 | Oag et al. | 60/747 |
| 5,479,782 | 1/1996 | Parker et al. | 60/747 |

FOREIGN PATENT DOCUMENTS 9207221 4/1992 WIPO .

*Primary Examiner*—Michael Koczo
*Attorney, Agent, or Firm*—Cushman Darby & Cushman IP Group of Pillsbury, Madison & Sutro LLP

[57] ABSTRACT

A gas turbine engine combustion chamber which has primary, secondary and tertiary combustion zones in flow series has a secondary fuel and air mixing duct and a tertiary fuel and air mixing duct. The secondary mixing duct has a secondary air intake at its upstream end and the tertiary mixing duct has a tertiary air intake at its upstream end. The tertiary air intake is arranged adjacent to the secondary air intake. A combined secondary and tertiary fuel system is provided to supply fuel to the secondary and tertiary mixing ducts. The fuel system comprises a manifold arranged adjacent to the secondary mixing duct but is spaced from the tertiary mixing duct by the secondary mixing duct. The manifold has apertures to direct fuel towards the tertiary air intake across the secondary air intake. Variations in fuel pressure cause the fuel to flow into the secondary air intake or the tertiary air intake.

18 Claims, 4 Drawing Sheets

GAS TURBINE ENGINE COMBUSTION CHAMBER

FIELD OF THE INVENTION

The present invention relates to a gas turbine engine combustion chamber.

BACKGROUND OF THE INVENTION

In order to meet the emission level requirements for industrial low emission gas turbine engines, staged combustion is required in order to minimise the quantity of the oxides of nitrogen (NOx) produced. Currently the emission level requirement is for less than 25 volumetric parts per million of NOx for an industrial gas turbine exhaust. The fundamental way to reduce emissions of nitrogen oxides is to reduce the combustion reaction temperature, and this requires premixing of the fuel and all the combustion air before combustion takes place. The oxides of nitrogen (NOx) are commonly reduced by a method which uses two stages of fuel injection. Our UK patent no. 1489339 discloses two stages of fuel injection. Our International patent application no WO92/07221 discloses two and three stages of fuel injection. In staged combustion, all the stages of combustion seek to provide lean combustion and hence the low combustion temperatures required to minimise NOx. The term lean combustion means combustion of fuel in air where the fuel to air ratio is low, i.e. less than the stoichiometric ratio. In order to achieve the required low emissions of NOx and CO it is essential to mix the fuel and air uniformly so that it has less than a 3.0% variation from the mean concentration before the combustion takes place.

The industrial gas turbine engine disclosed in our International patent application no WO92/07221 uses a plurality of tubular combustion chambers, whose longitudinal axes are arranged in generally radial directions. The inlets of the tubular combustion chambers are at their radially outer ends, and transition ducts connect the outlets of the tubular combustion chambers with a row of nozzle guide vanes to discharge the hot gases axially into the turbine sections of the gas turbine engine. Each of the tubular combustion chambers has an annular secondary fuel and air mixing duct which surrounds the primary combustion zone. Also each of the tubular combustion chambers of the three stage variant has an annular tertiary fuel and air mixing duct which surrounds the secondary combustion zone.

A set of primary fuel injectors is provided to supply fuel into the primary combustion zone, a set of secondary fuel injectors is provided to supply fuel into the upstream end of the secondary fuel and air mixing duct and a set of tertiary fuel injectors is provided to supply fuel into the upstream end of the tertiary fuel and air mixing duct. Each of three sets of fuel injectors requires its own fuel manifold. This requirement for three sets of fuel injectors and fuel manifolds makes the arrangement very complicated.

SUMMARY OF THE INVENTION

The present invention seeks to provide a novel gas turbine engine combustion chamber which overcomes the above mentioned problem.

The present invention provides a gas turbine engine combustion chamber comprising at least one combustion zone defined by at least one peripheral wall, means to define at least one first fuel and air mixing duct, each first fuel and air mixing duct is in fluid flow communication at its downstream end with the at least one combustion zone, each first fuel and air mixing duct has air intake means at its upstream end to supply air into the first fuel and air mixing duct, means to define at least one second fuel and air mixing duct, each second fuel and air mixing duct is in fluid flow communication at its downstream end with the at least one combustion zone, each second fuel and air mixing duct has air intake means at its upstream end to supply air into the second fuel and air mixing duct, fuel injector means to supply fuel to the first and second fuel and air mixing ducts, the fuel injector means comprises a fuel manifold having at least one aperture arranged to direct fuel towards the second air intake means across the first air intake means, means to vary the pressure of the fuel supplied to the fuel injector means such that in operation at pressures greater than a predetermined pressure the fuel is supplied into the at least one second fuel and air mixing duct and at pressures lower than the predetermined pressure the fuel is supplied into the at least one first fuel and air mixing duct.

Preferably a primary combustion zone is defined by at least one peripheral wall and an upstream end wall connected to the upstream end of the at least one peripheral wall, the upstream wall has at least one aperture, primary air intake means and primary fuel injector means to supply air and fuel respectively through the at least one aperture into the primary combustion zone, a secondary combustion zone in the interior of the combustion chamber downstream of the primary combustion zone, means to define at least one secondary fuel and air mixing duct, each secondary fuel and air mixing duct is in fluid flow communication at its downstream end with the secondary combustion zone, each secondary fuel and air mixing duct has secondary air intake means at its upstream end to supply air into the secondary fuel and air mixing duct, a tertiary combustion zone in the interior of the combustion chamber downstream of the secondary combustion zone, means to define at least one tertiary fuel and air mixing duct, each tertiary fuel and air mixing duct is in fluid flow communication at its downstream end with the tertiary combustion zone, each tertiary fuel and air mixing duct has tertiary air intake means at its upstream end to supply air into the tertiary fuel and air mixing duct, the tertiary air intake means is arranged adjacent to the secondary air intake means, secondary fuel injector means to supply fuel to the secondary fuel and air mixing duct and to the tertiary fuel and air mixing duct, the secondary fuel injector means comprises a fuel manifold which is arranged adjacent to the secondary fuel and air mixing duct but is spaced from the tertiary fuel and air mixing duct by the secondary fuel and air mixing duct, the fuel manifold has at least one aperture arranged to direct fuel towards the tertiary air intake means across the secondary air intake means, means to vary the pressure of the fuel supplied to the secondary fuel injector such that in operation at pressures greater than a predetermined pressure the fuel is supplied into the at least one tertiary fuel and air mixing duct and at pressures lower than the predetermined pressure the fuel is supplied into the at least one secondary fuel and air mixing duct.

The tertiary air intake means may be arranged downstream of the secondary air intake means, the fuel manifold is arranged upstream of the secondary air intake means, and the at least one aperture in the manifold directs air in a downstream direction.

The manifold may include at least one hollow cylindrical member extending across the secondary air intake means, the at least one hollow cylindrical member has apertures extending radially therethrough to inject fuel into the at least one secondary fuel and air mixing duct.

The combustion chamber may be tubular, the peripheral wall of the primary combustion zone is annular and the upstream wall has a single aperture, the at least one secondary fuel and air mixing duct is arranged around the primary combustion zone, the at least one tertiary fuel and air mixing duct is arranged around the secondary combustion zone.

The hollow cylindrical member may extend axially with respect to the axis of the combustion chamber.

The apertures in the hollow cylindrical member may be arranged to direct the fuel circumferentially.

The fuel manifold may have a plurality of apertures.

The fuel manifold may have a plurality of hollow cylindrical members.

The fuel manifold may be annular.

The apertures and the hollow cylindrical members may be arranged alternately circumferentially around the annular manifold.

There may be a plurality of secondary fuel and air mixing ducts and a plurality of tertiary fuel and air mixing ducts.

The manifold may have a plurality of apertures, at least one aperture is arranged to direct fuel towards each tertiary fuel and air mixing duct.

The manifold may have a plurality of hollow cylindrical members, at least one hollow cylindrical member is arranged to supply fuel into each secondary fuel and air mixing duct.

The combustion chamber may be annular, the primary combustion zone is annular, the annular primary combustion zone is defined by a first annular wall, a second annular wall arranged radially inwardly of the first annular wall, and the upstream end wall, the first and second annular walls are secured at their upstream ends to the upstream end wall, the upstream end wall has a plurality of apertures, at least one secondary fuel and air mixing duct arranged around the first annular wall of the primary combustion zone, at least one secondary fuel and air mixing duct arranged within the second annular wall of the primary combustion zone, at least one tertiary fuel and air mixing duct arranged around the secondary combustion zone and at least one tertiary fuel and air mixing duct arranged within the secondary combustion zone.

The tertiary air intake means may be arranged radially outwardly or radially inwardly of the secondary air intake means, the fuel manifold is arranged radially inwardly or radially outwardly respective of the secondary air intake means, and the at least one aperture in the manifold directs air radially outwardly or radially inwardly respectively.

The manifold may include at least one hollow cylindrical member extending radially across the secondary air intake means, the at least one hollow cylindrical member has a plurality of apertures extending radially therethrough to inject fuel into the at least one secondary fuel and air mixing duct.

BRIEF DESCRIPTION OF THE DRAWINGS

The present invention will be more fully described by way of example with reference to the accompanying drawings, in which.

DETAILED DESCRIPTION OF THE INVENTION

Figure 1:
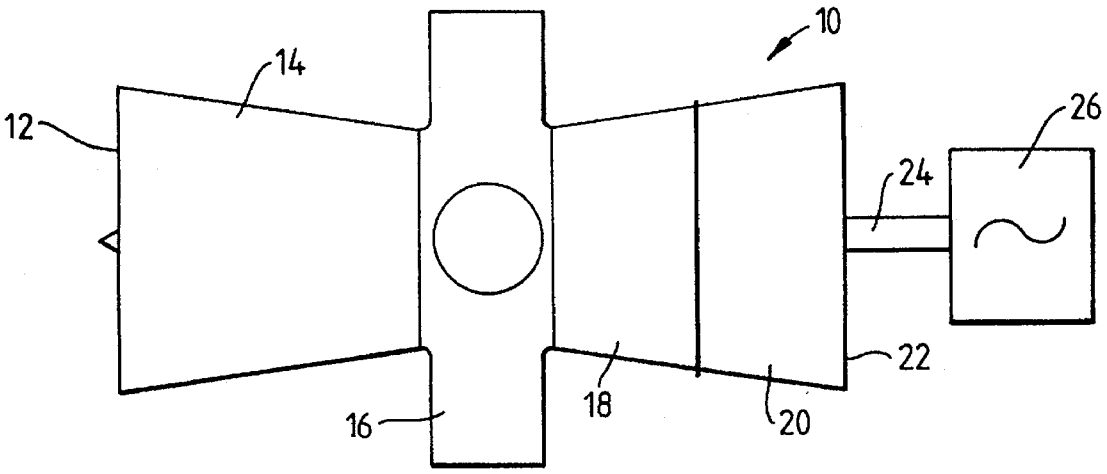
FIG. 1 is a view of a gas turbine engine having a combustion chamber assembly according to the present invention.

An industrial gas turbine engine 10, shown in FIG. 1, comprises in axial flow series an inlet 12, a compressor section 14, a combustion chamber assembly 16, a turbine section 18, a power turbine section 20 and an exhaust 22. The turbine section 18 is arranged to drive the compressor section 14 via one or more shafts (not shown). The power turbine section 20 is arranged to drive an electrical generator 26 via a shaft 24. However, the power turbine section 20 may be arranged to provide drive for other purposes. The operation of the gas turbine engine is quite conventional, and will not be discussed further.

Figure 3:
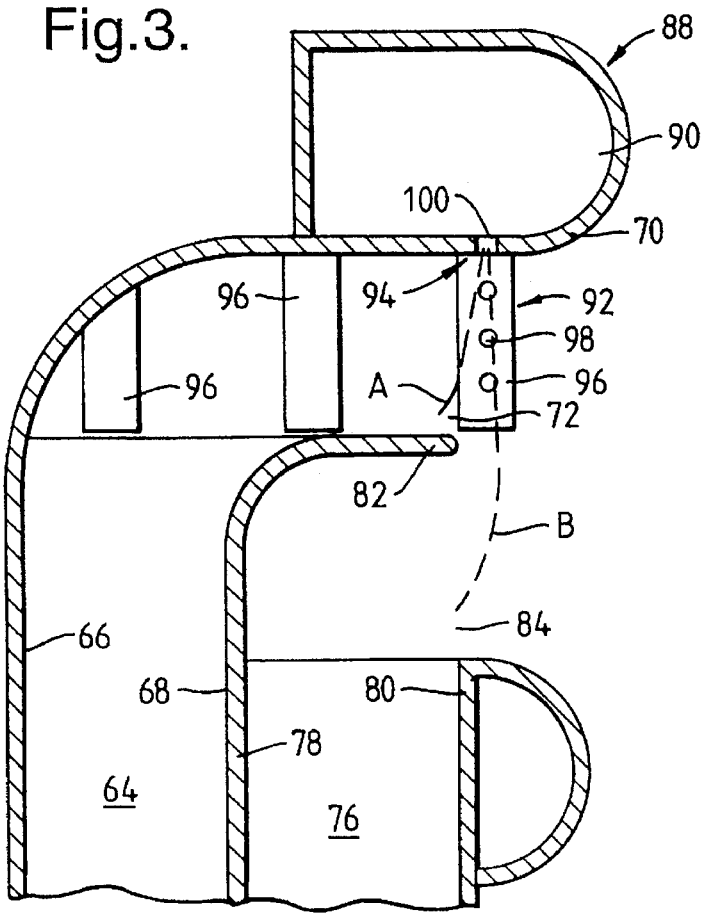
FIG. 3 is a further enlarged longitudinal cross-sectional view of the upstream ends of a fuel and air mixing duct.
Figure 2:
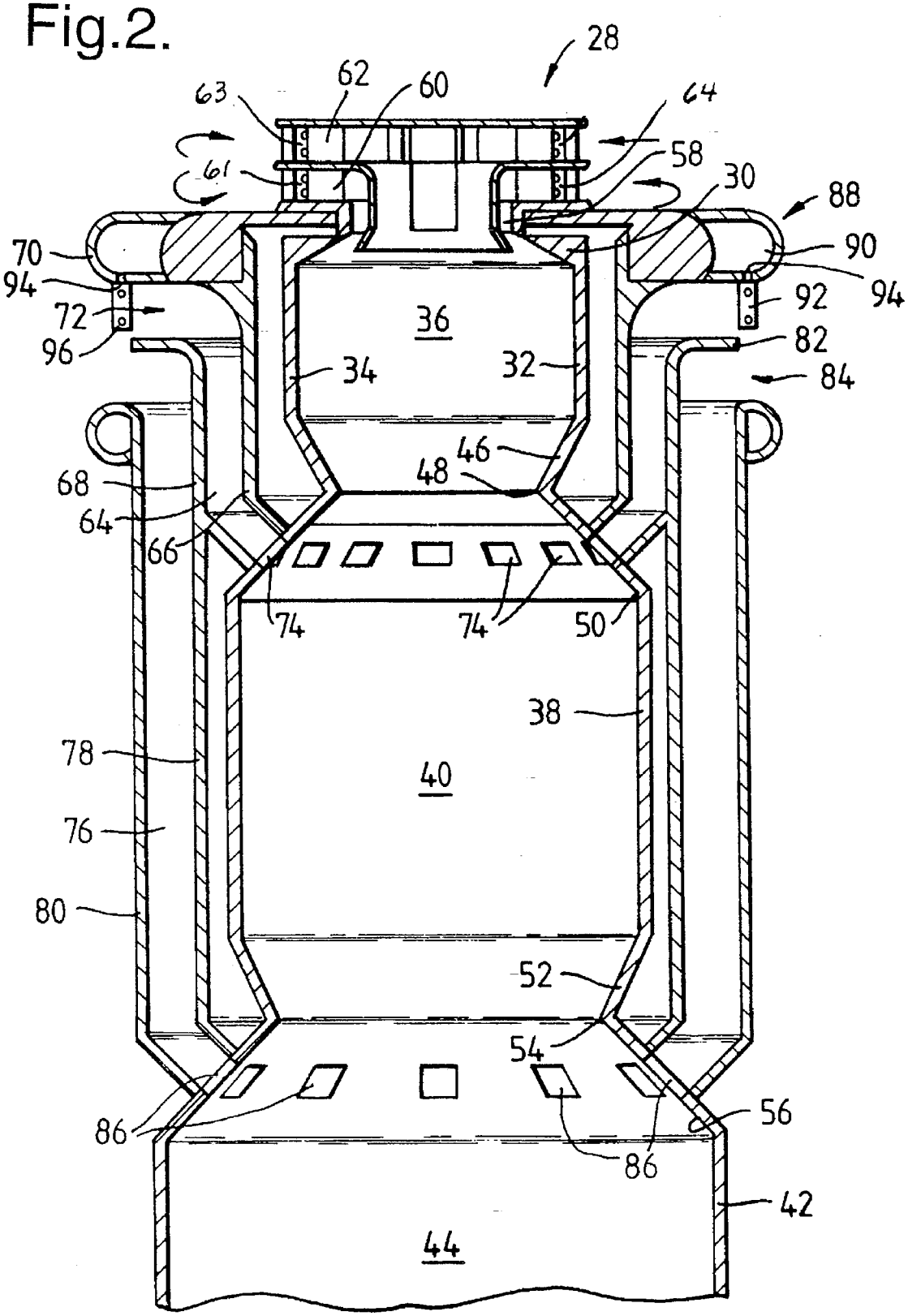
FIG. 2 is an enlarged longitudinal cross-sectional view through the combustion chamber shown in FIG. 1.

The combustion chamber assembly 16 is shown more clearly in FIGS. 2 and 3. The combustion chamber assembly 16 comprises a plurality of, for example nine, equally circumferentially spaced tubular combustion chambers 28. The axes of the tubular combustion chambers 28 are arranged to extend in generally radial directions. The inlets of the tubular combustion chambers 44 are at their radially outermost ends and their outlets are at their radially innermost ends.

Each of the tubular combustion chambers 28 comprises an upstream wall 30 secured to the upstream end of an annular wall 32. A first, upstream portion 34 of the annular wall 32 defines a primary combustion zone 36. A second intermediate portion 38 of the annular wall 32 defines a secondary combustion zone 40 and a third, downstream portion 42 of the annular wall 32 defines a tertiary combustion zone 44. The downstream end of the first portion 34 has a frustoconical portion 46 which reduces in diameter to a throat 48. The second portion 38 of the annular wall 32 has a greater diameter than the first portion 34. A frustoconical portion 50 interconnects the throat 48 and the upstream end of the second portion 38. The downstream end of the second portion 38 has a frustroconical portion 52 which reduces in diameter to a throat 54. The third portion 42 of the annular wall 32 has a greater diameter than the second portion 38. A frustroconical portion 56 interconnects the throat 54 and the upstream end of the third portion 42.

The upstream wall 30 of each of the tubular combustion chambers 28 has an aperture 58 to allow the supply of air and fuel into the primary combustion zone 36. A first radial flow swirler 60 is arranged coaxially with the aperture 58 in the upstream wall 30 and a second radial flow swirler 62 is arranged coaxially with the aperture 58 in the upstream wall 30. The first radial flow swirler 60 is positioned axially downstream, with respect to the axis of the tubular combustion chamber, of the second radial flow swirler 62. The first radial flow swirler 60 has a plurality of fuel injectors 61, each of which is positioned in a passage formed between two vanes of the swirler. The second radial flow swirler 62 has a plurality of fuel injectors 63, each of which is positioned in a passage formed between two vanes of the swirler. The first and second radial flow swirlers 60 and 62 are arranged such that they swirl the air in opposite directions. For a more detailed description of the use of the two radial flow swirlers and the fuel injectors positioned in the passages formed between the vanes see our International patent application no WO92/07221. The primary fuel and air is mixed together in the passages between the vanes of the first and second radial flow swirlers 60 and 62.

An annular secondary fuel and air mixing duct 64 is provided for each of the tubular combustion chambers 28. Each secondary fuel and air mixing duct 64 is arranged coaxially around the primary combustion zone 36. Each of the secondary fuel and air mixing ducts 64 is defined between a second annular wall 66 and a third annular wall 68. The second annular wall 66 defines the radially inner extremity of the secondary fuel and air mixing duct 64 and the third annular wall 68 defines the radially outer extremity of the secondary fuel and air mixing duct 64. The axially upstream end 70 of the second annular wall 66 is curved radially outwardly so that it is spaced axially from the upstream end of the third annular wall 68. The upstream end 70 of the second annular wall 66 is secured to a side plate of the first radial flow swirler 60. The secondary fuel and air mixing duct 66 has a secondary air intake 72 defined axially between the upstream end of the second annular wall 66 and the upstream end of the third annular wall 68.

At the downstream end of the secondary fuel and air mixing duct 64, the second and third annular walls 66 and 68 respectively are secured to the frustroconical portion 50, and the frustoconical portion 50 is provided with a plurality of equi-circumferentially spaced apertures 74. The apertures 74 are arranged to direct the fuel and air into the secondary combustion zone 40 in the tubular combustion chamber 28, in a downstream direction towards the axis of the tubular combustion chamber 28. The apertures 74 may be circular or slots and are of equal flow area.

An annular tertiary fuel and air mixing duct 76 is provided for each of the tubular combustion chambers 28. Each tertiary fuel and air mixing duct 76 is arranged coaxially around the secondary combustion zone 42 and also coaxially around a downstream portion of the secondary fuel and air mixing duct 64. Each of the tertiary fuel and air mixing ducts 76 is defined between a fourth annular wall 78 and a fifth annular wall 80. The fourth annular wall 78 defines the radially inner extremity of the tertiary fuel and air mixing duct 76 and the fifth annular wall 80 defines the radially outer extremity of the tertiary fuel and air mixing duct 76. The axially upstream end 82 of the fourth annular wall 78 is curved radially outwardly so that it is spaced axially from the upstream end of the fifth annular wall 80. The upstream end of the fourth annular wall 78 is adjacent to and is secured to the upstream end of the third annular wall 68. The tertiary fuel and air mixing duct 76 has a tertiary air intake 84 defined axially between the upstream end of the fourth annular wall 78 and the upstream end of the fifth annular wall 80. It can be seen that the tertiary air intake 84 is axially downstream of and is adjacent to the secondary air intake 72.

At the downstream end of the tertiary fuel and air mixing duct 76, the fourth and fifth annular walls 78 and 80 respectively are secured to the frustoconical portion 56, and the frustoconical portion 56 is provided with a plurality of equi-circumferentially spaced apertures 86. The apertures 86 are arranged to direct the fuel and air into the tertiary combustion zone 44 in the tubular combustion chamber 28, in a downstream direction towards the axis of the tubular combustion chamber 28. The apertures 86 may be circular or slots and are of equal flow area.

A combined secondary and tertiary fuel system 88 is provided to supply fuel to the secondary and tertiary fuel and air mixing ducts 64 and 76 respectively of each tubular combustion chamber 28. The combined secondary and tertiary fuel system 88 comprises an annular fuel manifold 90 which has a plurality of secondary fuel injectors 92 and a plurality of secondary/tertiary fuel injectors 94. Each of the secondary fuel injectors 92 comprises a hollow cylindrical member 96 which extends axially with respect to the tubular combustion chamber 28. The annular fuel manifold 90 is arranged coaxially with the tubular combustion chamber 28. The hollow cylindrical members 96 are provided with a plurality of apertures 98 through which the fuel is injected into the secondary fuel and air mixing duct 64. The apertures 98 are of equal diameters and are spaced apart axially along the hollow cylindrical member 96 at suitable positions, and the apertures 98 are arranged at diametrically opposite sides of the hollow cylindrical member 96 so that the fuel injectors 92 inject the fuel circumferentially/tangentially with respect to the axis of the tubular combustion chamber 28. The hollow cylindrical members 96 are arranged immediately radially outwardly of the secondary air intake 72 and extend axially across the secondary air intake 72.

Figure 5:
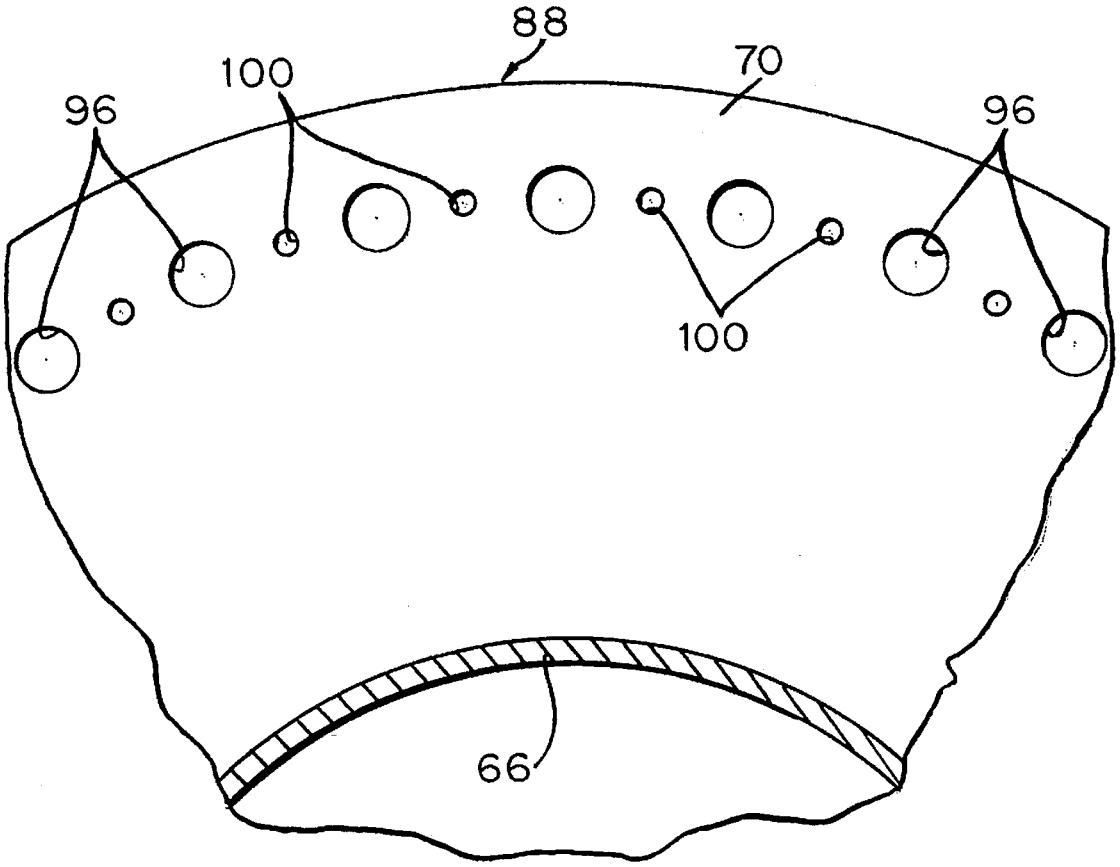
FIG. 5 is a sectional view on line 5—5 in FIG. 3.

The hollow cylindrical members 96 are equi-circumferentially spaced around the annular manifold 90 to provide a uniform fuel and air mixture. The secondary/tertiary fuel injectors 94 are also equi-circumferentially spaced around the annular manifold 90 and each secondary/tertiary fuel injector 94 is positioned between two of the secondary fuel injectors 92 such that the secondary and secondary/tertiary fuel injectors 92 and 94 respectively are arranged alternately circumferentially around the annular fuel manifold 90 as shown in FIG. 5. Each of the secondary/tertiary fuel injectors 94 simply comprises an aperture 100 in the annular fuel manifold 90 which is arranged to direct a Jet of fuel axially towards and across secondary air intake 72 to the tertiary air intake 84.

In operation of the gas turbine engine at the designed operating point the secondary fuel injectors 92 supply fuel into the secondary fuel and air mixing duct 64 to produce a uniform air to fuel ratio. The secondary fuel injectors 92 supply fuel into the secondary fuel and air mixing duct 64 at all operating conditions except during the engine starting when a pilot burner alone is used. The secondary/tertiary fuel injectors 94 supply fuel to the secondary fuel and air mixing duct 64 for fuel pressures lower than a predetermined value but supply fuel to the tertiary fuel and air mixing duct 76 for fuel pressures greater than the predetermined value. The fuel flow rate/fuel pressure is increased by the fuel pumps as more power is required from the gas turbine engine.

An increase of fuel pressure causes the momentum of the fuel jets issuing from the secondary/tertiary fuel injectors 94 to increase and above the predetermined value of fuel pressure the momentum of the fuel jets issuing from the secondary/tertiary fuel injectors 94 is such that the fuel jets have sufficient momentum to flow axially beyond the third and fourth annular walls 68 and 78 into the tertiary fuel and air mixing duct 76. Line A in FIG. 3 illustrates the fuel Jets for fuel pressures less than the predetermined value and line B illustrates the fuel jets for fuel pressures greater than the predetermined value.

As an example 32 secondary fuel injectors and 32 secondary/tertiary fuel injectors are used.

It is also possible to arrange for a plurality of secondary fuel and air mixing ducts to surround the primary combustion zone and a plurality of tertiary fuel and air mixing ducts to surround the secondary combustion zone as described in our copending UK patent application no. 9310690.4 filed on 24 Jul. 1993 which is hereby incorporated by reference. In that case each secondary fuel and air mixing duct has at least one secondary fuel injector. Each secondary/tertiary fuel injector is arranged to supply either one of the secondary fuel and air mixing ducts or one of the tertiary fuel and air mixing ducts.

Figure 4:
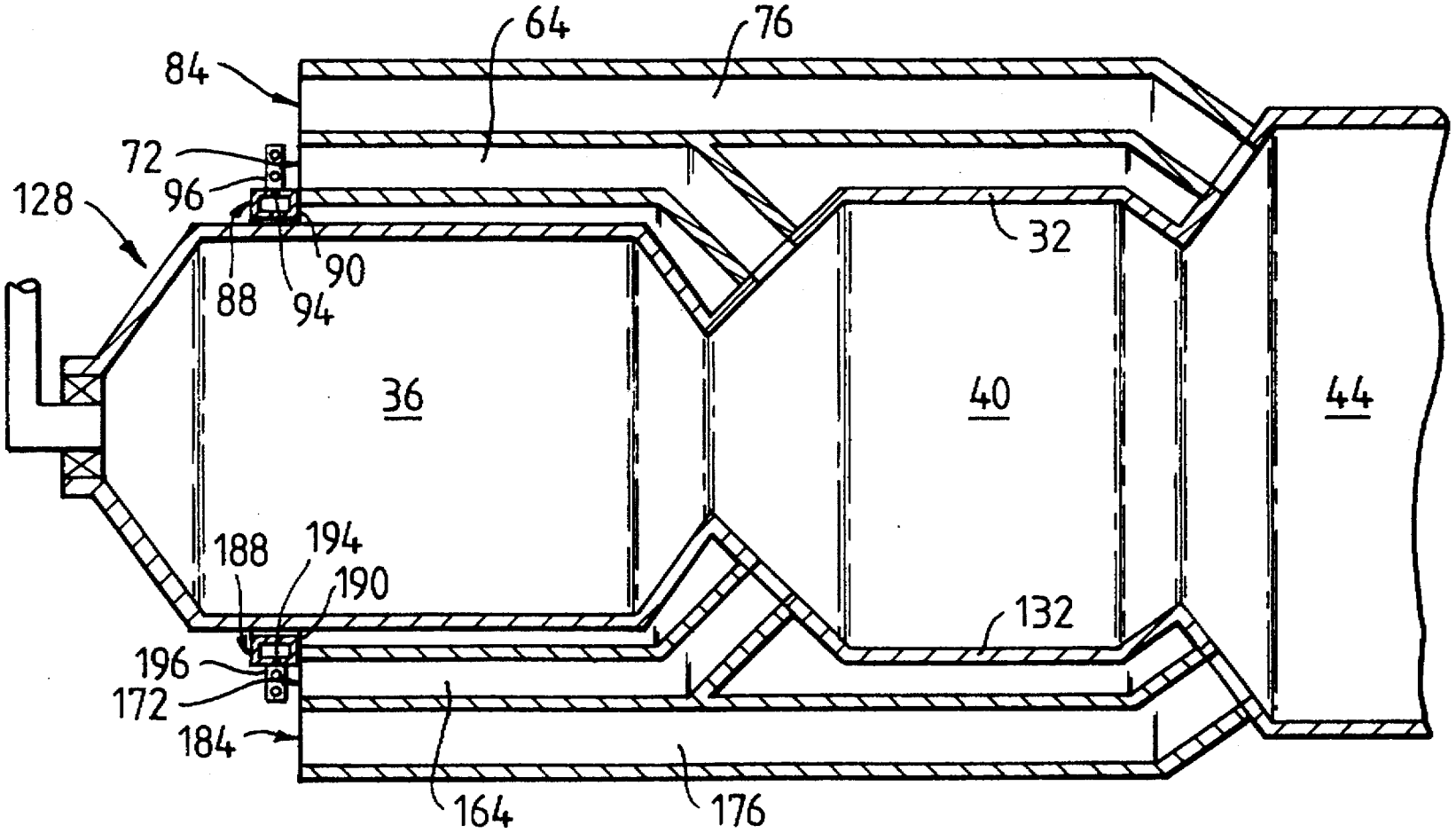
FIG. 4 is an enlarged cross-sectional view through an alternative combustion chamber assembly according to the present invention.

The invention has been described with reference to staged combustion in tubular combustion chambers, however it may also be applied to staged combustion in annular combustion chambers as shown in FIG. 4. An annular combustion chamber 128 has an annular primary combustion zone 36, an annular secondary combustion zone 40 and an annular tertiary combustion zone 44 defined between a radially outer annular wall 32 and a radially inner annular wall 132. A first secondary annular fuel and air mixing duct 64 is arranged radially outwardly of the annular primary combustion zone 36 and a second secondary annular fuel and air mixing duct 164 is arranged radially inwardly of the annular primary combustion zone 36. A first tertiary annular fuel and air mixing duct 76 is arranged radially outwardly of the annular secondary combustion zone 40 and also radially outwardly of the first secondary mixing duct 164. A second tertiary annular fuel and air mixing duct 176 is arranged radially inwardly of the annular secondary combustion zone 40 and also radially inwardly of the secondary mixing duct 164. The secondary fuel and air mixing ducts 64 and 164 have secondary air intakes 72 and 172 respectively at their axially upstream ends. The tertiary fuel and air mixing ducts 76 and 176 have tertiary air intakes 84 and 184 respectively at their axially upstream ends. It is to be noted that the tertiary air intake 84 is radially outward of and adjacent to the secondary air intake 72 and is substantially in the same axial position as the secondary air intake 72. Similarly the tertiary air intake 184 is radially inward of, and is adjacent to the secondary air intake 172 and is substantially in the same axial position as the secondary air intake 172.

A first combined secondary and tertiary fuel system 88 is provided to supply fuel to the secondary and tertiary fuel and air mixing ducts 64 and 76 respectively and a second combined secondary and tertiary fuel system 188 is provided to supply fuel to the secondary and tertiary fuel and air mixing ducts 164 and 176 respectively. The combined secondary and tertiary fuel system 88 and 188 are substantially the same as that described with reference to FIG. 2. However, the hollow cylindrical members 96, 196 are arranged to extend radially with respect to the annular combustion chamber 128, across the secondary air intakes 72 and 172. The hollow members 96 extend radially outwardly from manifold 90 and the hollow members 196 extend radially inwardly from manifold 190. The secondary/tertiary fuel injectors 94 and 194 direct the fuel radially outwardly and radially inwardly respectively.

The invention is also applicable to the supplying of fuel to any two suitable fuel and air mixing ducts.

We claim:

1. A gas turbine engine combustion chamber having an interior defined by at least one peripheral wall, means to define at least one first fuel and air mixing duct, said first fuel and air mixing duct having an upstream and a downstream end, each first fuel and air mixing duct being in fluid flow communication at its downstream end with said interior of the combustion chamber, each first fuel and air mixing duct having air intake means at its upstream end to supply air into the first fuel and air mixing duct, means to define at least one second fuel and air mixing duct, said second fuel and air mixing duct having an upstream and a downstream end, each second fuel and air mixing duct being in fluid flow communication at its downstream end with said interior of the combustion chamber, each second fuel and air mixing duct having air intake means at its upstream end to supply air into the second fuel and air mixing duct, fuel injector means to supply fuel to the first and second fuel and air mixing ducts, the fuel injector means comprising a fuel manifold having at least one aperture arranged to direct fuel towards the second air intake means across the first air intake means, means to vary the pressure of the fuel supplied to the fuel injector means such that in operation at pressures greater than a predetermined pressure the fuel is supplied into the at least one second fuel and air mixing duct and at pressures lower than the predetermined pressure the fuel is supplied into the at least one first fuel and air mixing duct.

2. A gas turbine engine combustion chamber as claimed in claim 1 wherein said combustion chamber has an upstream end wall connected to the upstream end of the at least one peripheral wall, the upstream wall has at least one aperture, primary air intake means and primary fuel injector means being provided to supply air and fuel respectively through the at least one aperture into a primary combustion zone, a secondary combustion zone in the interior of the combustion chamber downstream of the primary combustion zone, said second fuel and air mixing duct being in fluid flow communication at its downstream end with the secondary combustion zone, each second fuel and air mixing duct having secondary air intake means at its upstream end to supply air into the second fuel and air mixing duct, a tertiary combustion zone in the interior of the combustion chamber downstream of the secondary combustion zone, means to define at least one tertiary fuel and air mixing duct, said tertiary fuel and air mixing duct having an upstream and a downstream end, each tertiary fuel and air mixing duct being in fluid flow communication at its downstream end with the tertiary combustion zone, each tertiary fuel and air mixing duct having tertiary air intake means at its upstream end to supply air into the tertiary fuel and air mixing duct, the tertiary air intake means being arranged adjacent to the secondary air intake means, secondary fuel injector means to supply fuel to the secondary fuel and air mixing duct and to the tertiary fuel and air mixing duct, the secondary fuel injector means comprising a fuel manifold which is arranged adjacent to the secondary fuel and air mixing duct but is spaced from the tertiary fuel and air mixing duct by the second fuel and air mixing duct, the fuel manifold having at least one aperture arranged to direct fuel towards the tertiary air intake means across the secondary air intake means, means to vary the pressure of the fuel supplied to the secondary fuel injector such that in operation at pressures greater than a predetermined pressure the fuel is supplied into the at least one tertiary fuel and air mixing duct and at pressures lower than the predetermined pressure the fuel is supplied into the at least one second fuel and air mixing duct.

3. A combustion chamber as claimed in claim 2 in which the tertiary air intake means is arranged downstream of the secondary air intake means, the fuel manifold is arranged upstream of the secondary air intake means, and the at least one aperture in the manifold directs fuel in a downstream direction.

4. A combustion chamber as claimed in claim 2 in which the manifold includes at least one hollow cylindrical member extending across the secondary air intake means, the at least one hollow cylindrical member has apertures extending radially therethrough to inject fuel into the at least one secondary fuel and air mixing duct.

5. A combustion chamber as claimed in claim 2 in which the combustion chamber is tubular, the peripheral wall of the primary combustion zone is annular and the upstream wall has a single aperture, the at least one secondary fuel and air mixing duct is arranged around the primary combustion zone, the at least one tertiary fuel and air mixing duct is arranged around the secondary combustion zone.

6. A combustion chamber as claimed in claim 4 in which the hollow cylindrical member extends axially with respect to the axis of the combustion chamber.

7. A combustion chamber as claimed in claim 6 in which the apertures in the hollow cylindrical member are arranged to direct the fuel circumferentially.

8. A combustion chamber as claimed in claim 2 in which the fuel manifold has a plurality of apertures.

9. A combustion chamber as claimed in claim 4 in which the fuel manifold has a plurality of hollow cylindrical members.

10. A combustion chamber as claimed in claim 9 in which the fuel manifold is annular.

11. A combustion chamber as claimed in claim 10 in which the fuel manifold has a plurality of apertures, the apertures in the fuel manifold and the hollow cylindrical members are arranged alternately circumferentially around the annular manifold.

12. A combustion chamber as claimed in claim 2 in which there are a plurality of secondary fuel and air mixing ducts and a plurality of tertiary fuel and air mixing ducts.

13. A combustion chamber as claimed in claim 12 in which the manifold has a plurality of apertures, at least one aperture is arranged to direct fuel towards each tertiary fuel and air mixing duct.

14. A combustion chamber as claimed in claim 13 in which the manifold has a plurality of hollow cylindrical members, at least one hollow cylindrical member is arranged to supply fuel into each secondary fuel and air mixing duct.

15. A combustion chamber as claimed in claim 2 in which the combustion chamber is annular, the primary combustion zone is annular, the annular primary combustion zone is defined by a first annular wall, a second annular wall arranged radially inwardly of the first annular wall, and the upstream end wall, the first and second annular walls are secured at their upstream ends to the upstream end wall, the upstream end wall has a plurality of apertures, at least one secondary fuel and air mixing duct arranged around the first annular wall of the primary combustion zone, at least one secondary fuel and air mixing duct arranged within the second annular wall of the primary combustion zone, at least one tertiary fuel and air mixing duct arranged around the secondary combustion zone and at least one tertiary fuel and air mixing duct arranged within the secondary combustion zone.

16. A combustion chamber as claimed in claim 15 in which the tertiary air intake means is arranged radially outwardly of the secondary air intake means, the fuel manifold being arranged radially inwardly respectively of the secondary air intake means, and the at least one aperture in the manifold directs air radially outwardly respectively.

17. A combustion chamber as claimed in claim 16 in which the manifold includes at least one hollow cylindrical member extending radially across the secondary air intake means, the at least one hollow cylindrical member has a plurality of apertures extending radially therethrough to inject fuel into the at least one secondary fuel and air mixing duct.

18. A combustion chamber as claimed in claim 15 in which the tertiary air intake means is arranged radially inwardly of the secondary air intake means, the fuel manifold is arranged radially outwardly respectively of the secondary air intake means and the at least one aperture in the manifold directs air radially inwardly.

* * * * *